US009609733B2

(12) United States Patent
Severance, Jr.

(10) Patent No.: US 9,609,733 B2
(45) Date of Patent: Mar. 28, 2017

(54) PLASMA ARC TORCH AND METHOD FOR ASSEMBLING AND DISASSEMBLING A PLASMA ARC TORCH

(71) Applicant: The ESAB Group, Inc., Florence, SC (US)

(72) Inventor: Wayne Stanley Severance, Jr., Darlington, SC (US)

(73) Assignee: The ESAB Group, Inc., Florence, SC (US)

( * ) Notice: Subject to any disclaimer, the term of this patent is extended or adjusted under 35 U.S.C. 154(b) by 593 days.

(21) Appl. No.: 14/077,879

(22) Filed: Nov. 12, 2013

(65) Prior Publication Data

US 2015/0129562 A1 May 14, 2015

(51) Int. Cl.
*B23K 10/00* (2006.01)
*H05H 1/34* (2006.01)

(52) U.S. Cl.
CPC ..... *H05H 1/34* (2013.01); *H05H 2001/3436* (2013.01); *H05H 2001/3442* (2013.01); *H05H 2001/3457* (2013.01); *Y10T 29/49963* (2015.01)

(58) Field of Classification Search
CPC .... H05H 1/24; H05H 1/34; H05H 2001/3436; H05H 2001/3442; H05H 2001/3457; H05H 2001/3489; B23K 9/00; B23K 9/26; B23K 9/133; B23K 9/173; B23K 10/00
See application file for complete search history.

(56) References Cited

U.S. PATENT DOCUMENTS

| | | | |
|---|---|---|---|
| 3,294,953 | A | 12/1966 | Spies, Jr. |
| 5,396,043 | A | 3/1995 | Couch, Jr. et al. |
| 6,096,993 | A | 8/2000 | Marhic et al. |
| 6,979,796 | B1 | 12/2005 | Hardwick |
| 7,038,168 | B2 | 5/2006 | Kensrue et al. |
| 7,256,366 | B2 | 8/2007 | Severance, Jr. |
| 7,423,235 | B2 | 9/2008 | Severance, Jr. |
| 8,258,423 | B2 | 9/2012 | Severance, Jr. et al. |

(Continued)

FOREIGN PATENT DOCUMENTS

| | | | |
|---|---|---|---|
| JP | 2013-051064 | A | 3/2013 |
| WO | 2013-028487 | A1 | 2/2013 |

OTHER PUBLICATIONS

International Search Report and Written Opinion Mailed Feb. 26, 2015 for corresponding PCT Application No. PCT/US2014/063076 filed Oct. 30, 2014.

*Primary Examiner* — Brian Jennison

(57) ABSTRACT

A front end assembly for a plasma torch and methods for assembling and disassembling a torch wherein a plurality of front end parts form a unit that is removable from, and installable in, the torch in a single operation without a special fixture. The front end assembly includes a nozzle retaining cup body connectable to a body of the torch, and a forward end connectable to a shield retainer. A nozzle retaining cup insert fits into the nozzle retaining cup body. The shield retainer has an inner surface for retaining the shield. A nozzle is received within the nozzle retaining cup insert. A stop on the nozzle engages the nozzle retaining cup insert when the front end assembly is removed from the torch so the nozzle does not remain in the torch. The shield engages an insulator, which engages the nozzle, to limit forward axial movement of the nozzle.

28 Claims, 11 Drawing Sheets

(56) References Cited

U.S. PATENT DOCUMENTS

| | | | | |
|---|---|---|---|---|
| 2006/0102598 | A1 | 5/2006 | Twarog et al. | |
| 2006/0196854 | A1* | 9/2006 | Severance ..... | H05H 1/34<br>219/121.48 |
| 2007/0138148 | A1 | 6/2007 | Severance, Jr. | |
| 2012/0298634 | A1 | 11/2012 | Severance, Jr. et al. | |

* cited by examiner

PLASMA ARC TORCH AND METHOD FOR ASSEMBLING AND DISASSEMBLING A PLASMA ARC TORCH

BACKGROUND OF THE INVENTION

Field of the Invention

Embodiments of the invention generally relate to plasma arc torches, and in particular relate to a plasma arc torch that is easy to assemble and disassemble.

Discussion of Related Art

Plasma arc torches generally include a torch body assembly that supports an electrode for emitting an electrical arc that attaches to a workpiece to be operated upon, and a nozzle for directing a flow of a plasma gas toward the workpiece such that the plasma gas stream surrounds the arc. The electrode and nozzle generally are regarded as "consumables" that are subject to deterioration during operation of the torch and that must be replaced periodically in order to restore the torch to a proper condition for satisfactory operation.

Typically a plasma arc torch includes a number of parts that must be removed in order to gain access to the consumables for replacement. In many plasma arc torches, these parts must be removed one at a time, and then reinstalled one at a time after replacement of the consumables. As can be appreciated this process is inefficient and cumbersome. Thus, there is a need for an improved plasma arc torch that includes features that make replacement of the consumable portions easier and faster than current arrangements.

SUMMARY OF THE INVENTION

A front end assembly is disclosed for a plasma arc torch. The front end assembly can include a nozzle retaining cup body having a rearward end removably connectable to a body of the plasma arc torch and a forward end removably connectable to a shield retainer. A nozzle retaining cup insert can be receivable in an interior space formed by the nozzle retaining cup body, the nozzle retaining cup insert having a forward portion extending forwardly beyond a forward end of the nozzle retaining cup body. The shield retainer may have a surface for engaging a shield. A nozzle may be receivable within an interior space formed by the nozzle retaining cup insert. A first central portion of the nozzle may have a first diameter. The first central portion may be positioned in close confronting relation with the forward portion of the nozzle retaining cup insert. The nozzle may further include a stop that is engageable with a nose portion of the nozzle retaining cup insert to prevent axial movement towards the rear of the nozzle retaining cup insert once the stop and the nose portion are engaged. An insulator may be disposed between the shield and the nozzle, where engagement of the shield with the insulator and engagement of the insulator with a forward facing surface of the nozzle limits forward axial movement of the nozzle.

A method is disclosed for assembling a front end unit for a plasma arc torch. The method may include inserting a rear portion of a nozzle through an ID of a nozzle retaining cup insert until a stop portion of the nozzle contacts a nose portion of the nozzle retaining cup insert, thereby engaging a seal between the nozzle and the nozzle retaining cup insert; inserting the nozzle retaining cup insert and nozzle into an ID of a nozzle retaining cup body so that a rearward surface the nozzle retaining cup insert engages a forward surface of the nozzle retaining cup body; mounting a gas diffuser on the nose portion of the nozzle; centering a shield on the nozzle using the gas diffuser; engaging the shield against the nose portion of the nozzle retaining cup insert; and screwing a shield retainer onto the nozzle retaining cup body so that the shield and the gas diffuser are locked thereto.

BRIEF DESCRIPTION OF THE DRAWINGS

The accompanying drawings illustrate preferred embodiments of the disclosed method so far devised for the practical application of the principles thereof, and in which.

DESCRIPTION OF EMBODIMENTS

The disclosed plasma arc torch will be described more fully hereinafter with reference to the accompanying drawings in which some but not all embodiments of the inventions are shown. Indeed, the disclosed torch and its features may be embodied in many different forms and should not be construed as limited to the embodiments set forth herein. Rather, the explicitly disclosed embodiments are provided so that this disclosure will satisfy applicable legal requirements.

Figure 1:
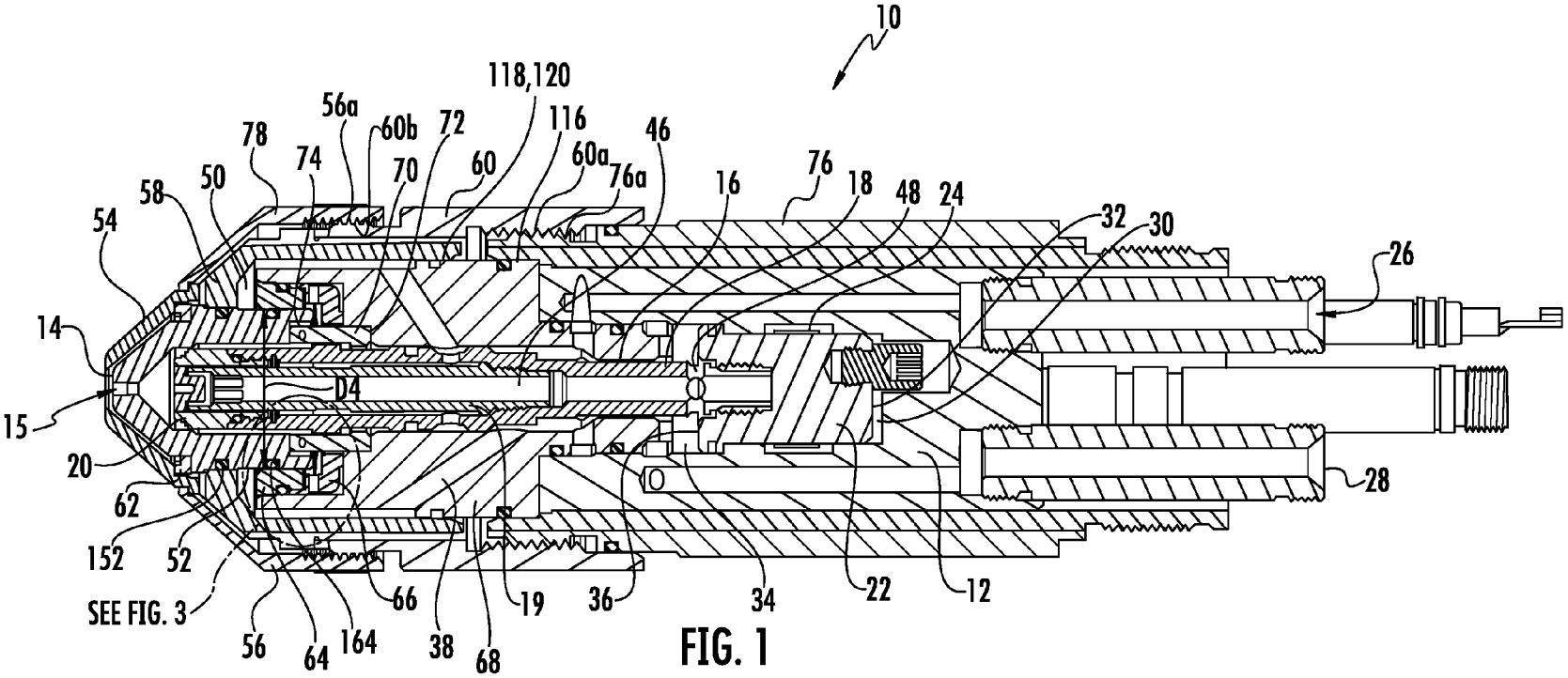
FIG. 1 is a cross-section view of an exemplary plasma torch.
Figure 2:
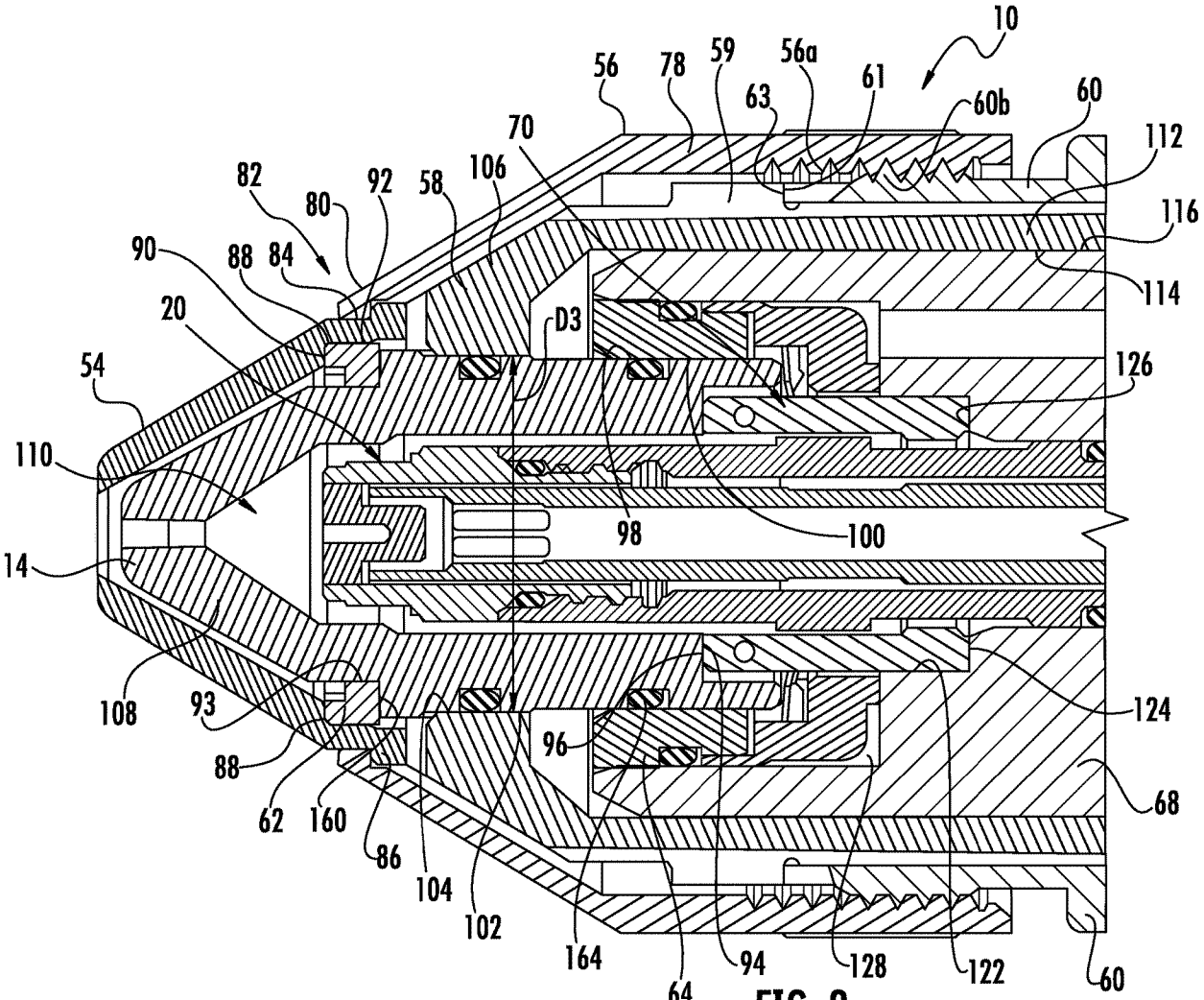
FIG. 2 is an enlarged cross-section view of a front-end portion of the plasma torch of FIG. 1, rotated 90-degrees.

With reference to FIGS. 1 and 2, a plasma arc torch 10 is shown. The torch can be a gas shielded plasma arc torch which provides, in addition to the plasma gas flowing through the nozzle orifice, a curtain or jet of shielding or secondary gas surrounding an electric arc during a working mode of operation of the torch. Usually a swirl is imparted to the shield gas. The torch 10 includes a main torch body 12, a nozzle 14 and an electrode assembly 16. The electrode assembly 16 may comprise several pieces including an electrode holder 18 at a first end of the electrode assembly, and an electrode 20 at a second end of the electrode assembly. The electrode holder 18 can be coupled to a piston 22 within the main torch body 12.

The piston 22 is situated in a piston cavity 24 within the main torch body 12 of the plasma torch 10. The piston cavity 24 is in communication with a first fluid passage 26 (FIG. 2) and a second fluid passage 28 (FIG. 1). In particular, the piston 22 may be arranged in the piston cavity 24 such that the first fluid passage 26 communicates with a first region 30 of the piston cavity 24 on a first side 32 of the piston 22 and the second fluid passage 28 communicates with a second region 34 of the piston cavity 24 on a second side 36 of the piston. A connecting pathway 38 conducts fluid between the first and second regions 30, 34 of the piston cavity 24. Thus, fluid may travel in through one of the first and second fluid passages 26, 28, into one of the first or second regions 30, 34 of the piston cavity 24, though the connecting pathway 38, into the other of the first and second regions of the piston cavity, and out through the other of the first and second fluid passages.

The first fluid and second fluid passages 26, 28 may connect to respective external lines (not shown) for supplying and returning fluid to the plasma torch 10. Thus, the fluid may travel in a closed-loop. In such embodiments the plasma torch 10 may further include a fluid heat exchanger (not shown), which cools the fluid. Use of a heat exchanger to cool the fluid may be advantageous because the fluid may be a coolant, such as water, which cools the plasma torch 10. The water may be mixed with ethylene glycol or propylene glycol to form coolant which resists freezing. Additionally or alternatively, the water may be mixed with additives configured to prevent corrosion, growth of algae, and/or growth of bacteria.

Two portions of the plasma torch 10 in particular which may benefit from cooling are the electrode 20 and the nozzle 14. Thus, in one embodiment, at least part of the connecting pathway 38 may be defined by an electrode fluid passage 46 within the electrode holder 18. By flowing fluid such that it contacts the electrode 20, the fluid can cool the electrode. For example, fluid may enter through one or more apertures 48 in the electrode holder 18 and travel through the electrode fluid passage 46, which can be defined in part by a coolant tube 19 coaxially displaced within the tubular electrode holder 18. In other embodiments, the connecting pathway 38 can additionally or alternatively be defined at least in part by the nozzle 14. For example, the connecting pathway 38 can comprise a circumferential channel 50 defined on one side by an outer surface 52 of the nozzle 14. Thus, by contacting the electrode 20 and/or the nozzle 14, the fluid can cool the plasma torch 10 during operation.

In the above-described closed-loop embodiments, the fluid is heated as it travels through the plasma torch 10 and thus as described above and a heat exchanger cools the fluid before it is returned to the plasma torch. In alternate embodiments, an open-loop may be formed in which fluid is directed through one of the first or second passages 26, 28 and out the other of the first or second passages without being recycled. Such embodiments may forego a heat exchanger because the warmed fluid exiting the plasma torch 10 is not returned into the plasma torch. Regardless of whether a closed-loop or open-loop fluid path is used, the fluid may be used for purposes other than just cooling the plasma torch 10. One such purpose is controlling the positioning of the electrode assembly 16 in order to start and operate the plasma torch 10. In this regard, the relative direction of travel of the fluid into or out of the first fluid passage 26 and the second fluid passage 28 may be used to control the positioning of the electrode assembly 16. For example, the electrode assembly 16 can be moved to a starting position in which the electrode 20 contacts the nozzle 14 by directing fluid through the first passage 26 to bias the piston 22 such that the electrode contacts the nozzle. When it is desired that the electrode assembly 16 be refracted to an operating position wherein the electrode 20 does not contact the nozzle 14, the fluid is directed to flow in an opposite direction, through the second fluid passage 28 into the second region 34 of the piston cavity 24, then through the connecting pathway 38 into the first region 30 of the piston cavity, and then out through the first fluid passage 26. This fluid flow in this opposite direction biases the piston 22 such that the electrode assembly 16 retracts to a position whereby the electrode 20 does not contact the nozzle 14.

In general, during starting of the torch 10, a difference in electrical voltage potential is established between the electrode 20 and the nozzle 14 so that an electric arc forms across the gap therebetween. Plasma gas is then flowed and the electric arc is blown outward from the nozzle orifice 15 until it attaches to a workpiece (not shown), at which point the nozzle 14 is disconnected from the electric source so that the arc exists between the electrode 20 and the workpiece. The plasma torch 10 is then in a working mode of operation. Further details regarding the function and operation of the disclosed plasma torch 10 may can be found in U.S. Pat. No. 8,258,423 to Severance, Jr. et al, and assigned to The ESAB Group, Inc., the entirety of which patent is incorporated by reference herein. It will be appreciated that although the disclosed arrangement is described in relation to a retract start torch, it is equally applicable to conventional high-frequency starting torches such as those described in U.S. Pat. No. 7,081,597 to Severance, Jr. et al, and assigned to The ESAB Group, Inc., the entirety of which patent is incorporated by reference herein.

As will be appreciated, certain of the front end components of the plasma torch 10 are subjected to a harsh (e.g., high temperature) environment during operation. The electrode and nozzle generally are regarded as "consumables" that are subject to deterioration during operation. As such, these components must be replaced periodically in order to restore the torch to a proper condition for satisfactory operation. The disclosed plasma torch 10 includes features that enable quick and easy replacement of these front end "consumables." In some embodiments, various of the front end components can be coupled together in a manner that enables them to be simply and easily removed and replaced as a single assembly.

In general, the front end components of the plasma torch 10 can include the nozzle 14, the electrode 20, a shield 54 that surrounds a front portion of the nozzle, a shield retainer 56 that retains the shield, a nozzle-retaining cup insert 58 that engages both the nozzle and the shield, and a nozzle-retaining cup body 60 that retains the nozzle-retaining cup insert. A generally cylindrical gas diffuser 62 may be disposed between the nozzle 14 and the shield 54. In alternative constructions the diffuser may replaced with an insulator which lacks features to direct the flow of shield gas. Such features may alternatively be integrally formed in another torch part such as the nozzle or shield. A front body insert cap 64 and a front body insert base 66 may retain the nozzle 14 with respect to a front insulator body 68 which extends forward from the main torch body 12 to enclose a forward portion of the electrode holder 18. A gas baffle 70 may surround a portion of the electrode holder 18. A rear portion 72 of the gas baffle 70 may be engaged with the front insulator body 68 and a forward portion 74 of the gas baffle may be engaged with the nozzle 14.

Although the illustrated embodiment shows the front body insert cap 64 and front body insert base 66 as being separate pieces, they could instead be combined to form a unitary front body insert. In addition, although the illustrated embodiment shows the gas baffle 70 as simply fit between the front insulator body 68 and the nozzle 14, the gas baffle 70 could have features that enable it to be part of the "front end" assembly. For example, the gas baffle 70 could be threaded into the nozzle 14. The threads could be positioned below the holes for swirling the gas or they could be above them. In the latter case, gas passages could be provided in the gas baffle by forming slots deeper than the threads in either the gas baffle or the nozzle, or the threads could be loose enough that gas could flow through the gaps in the threads. The gas baffle 70 could alternatively be plastic, and could be secured to the nozzle by snapping it into or onto the nozzle or by a press fit. Alternatively, the gas baffle 70 could be a ceramic material secured to the nozzle by an o-ring, a snap ring, or a spacer made of a resilient material. In addition or alternatively, the gas baffle can be adhered to the nozzle 14 to form the two pieces into a permanent assembly. In any of these cases, of course, the electrode holder 18 and gas baffle 70 would be configured so that the electrode holder doesn't secure the gas baffle within the torch. As such, the gas baffle 70 would be removed when the "front end" assembly is removed from the plasma torch.

It will be appreciated that although these elements are described as separate pieces, it is not critical that they be provided as such. As previously noted, for example, in some embodiments the gas diffuser 62 may be formed as an integral part of the nozzle 14. In addition or alternatively, the shield 54 and shield retainer 56 could be formed as a single piece, and/or the nozzle retaining cup insert 58 could be permanently attached to the nozzle retaining cup body 60 to constitute a nozzle-retaining cup. Other similar combinations and arrangements are also contemplated.

As will be described in greater detail later, it may be desirable to replace the electrode 20, nozzle 14 and the shield 54 at the same time, as they are most subject to damage or wearing during operation. With the disclosed arrangement, the front end interconnected parts (e.g., nozzle 14, gas diffuser 62, shield 54, shield retainer 56, nozzle retaining cup 58 insert and nozzle-retaining cup body 60) can be removed from the plasma torch 10 as a single unit. The electrode 20 may be separately removed once the aforementioned pieces are removed. The user may have a pre-assembled set of front end interconnected parts ready to join to the plasma torch 10 as a single unit. It will be appreciated that the advantage of the disclosed arrangement is that it does not require a specialized fixture or tools to assemble the front end replacement components, and users can assemble and disassemble the front end components with their hands.

The arrangement and inter-relation of the individual front-end components of the plasma torch 10 will now be described in greater detail. As shown in FIGS. 1 and 2, The nozzle retaining cup body 60 is a generally cylindrical sleeve that is engaged with the lower end of a torch outer housing 76 which surrounds the main torch body 12. Specifically, the nozzle retaining cup body 60 comprises a rearwardly positioned internally threaded portion 60*a* that engages corresponding external threads 76*a* formed on the torch outer housing 76. The nozzle retaining cup body 60 further comprises a forwardly positioned externally threaded portion 60*b* that engages corresponding internal threads 56*a* formed on a rearward cylindrical portion 78 of the shield retainer 56.

The shield retainer 56 has a forward portion 80 of generally frustoconical form. The forward end 82 of the forward portion 80 includes an internal circumferential lip 84 that engages an external circumferential shoulder 86 of the shield 54. While this is one exemplary way for the shield retainer to secure the shield, other arrangements such as threads can also be used. The shield 54 also has a generally frustoconical shape that includes an internal circumferential recess 88, positioned forward of the external circumferential shoulder 86. The internal circumferential recess 88 is shaped to engage a forward face 90 and an outer face 92 of the gas diffuser 62, thus capturing and centering the gas diffuser therein.

Figure 6A:
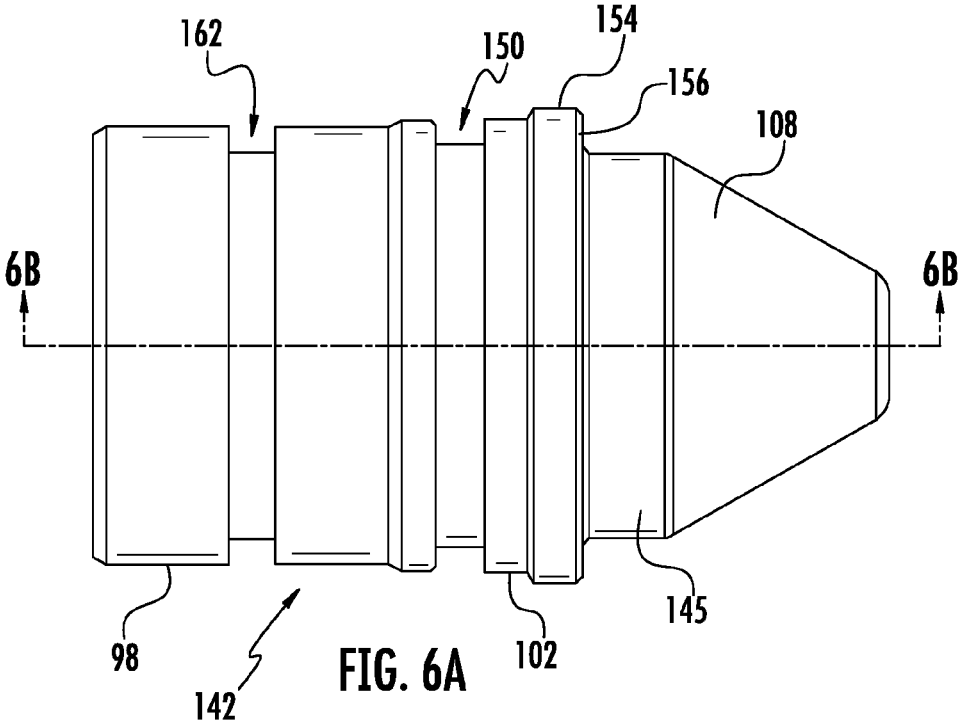
FIGS. 6A and 6B are cross-section, side and isometric views of a nozzle portion of the plasma torch of FIG. 1.
Figure 6B:
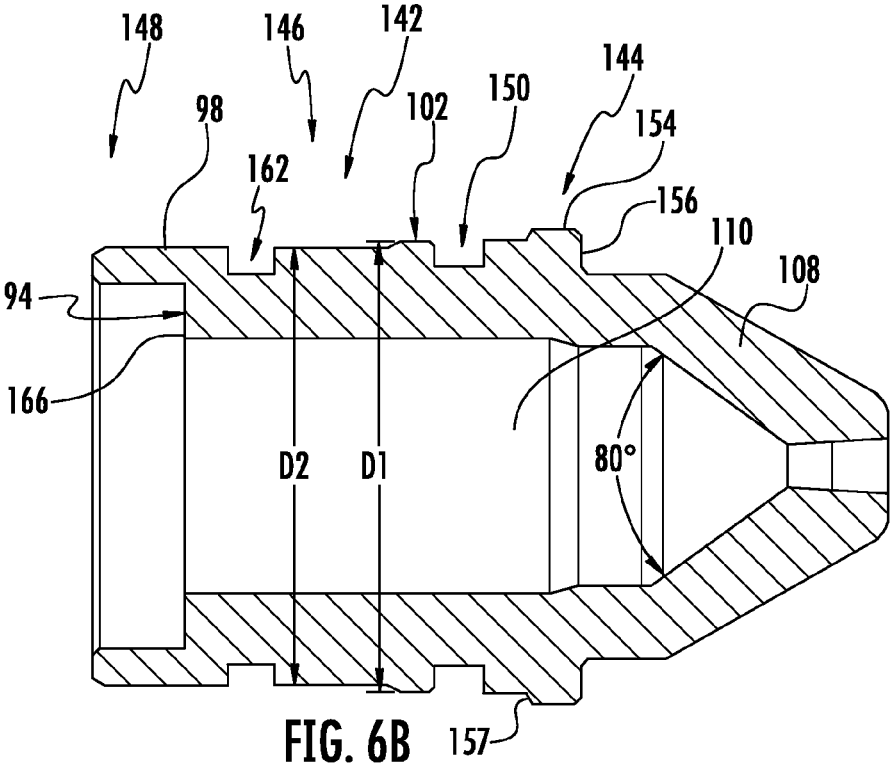
Figure 7:
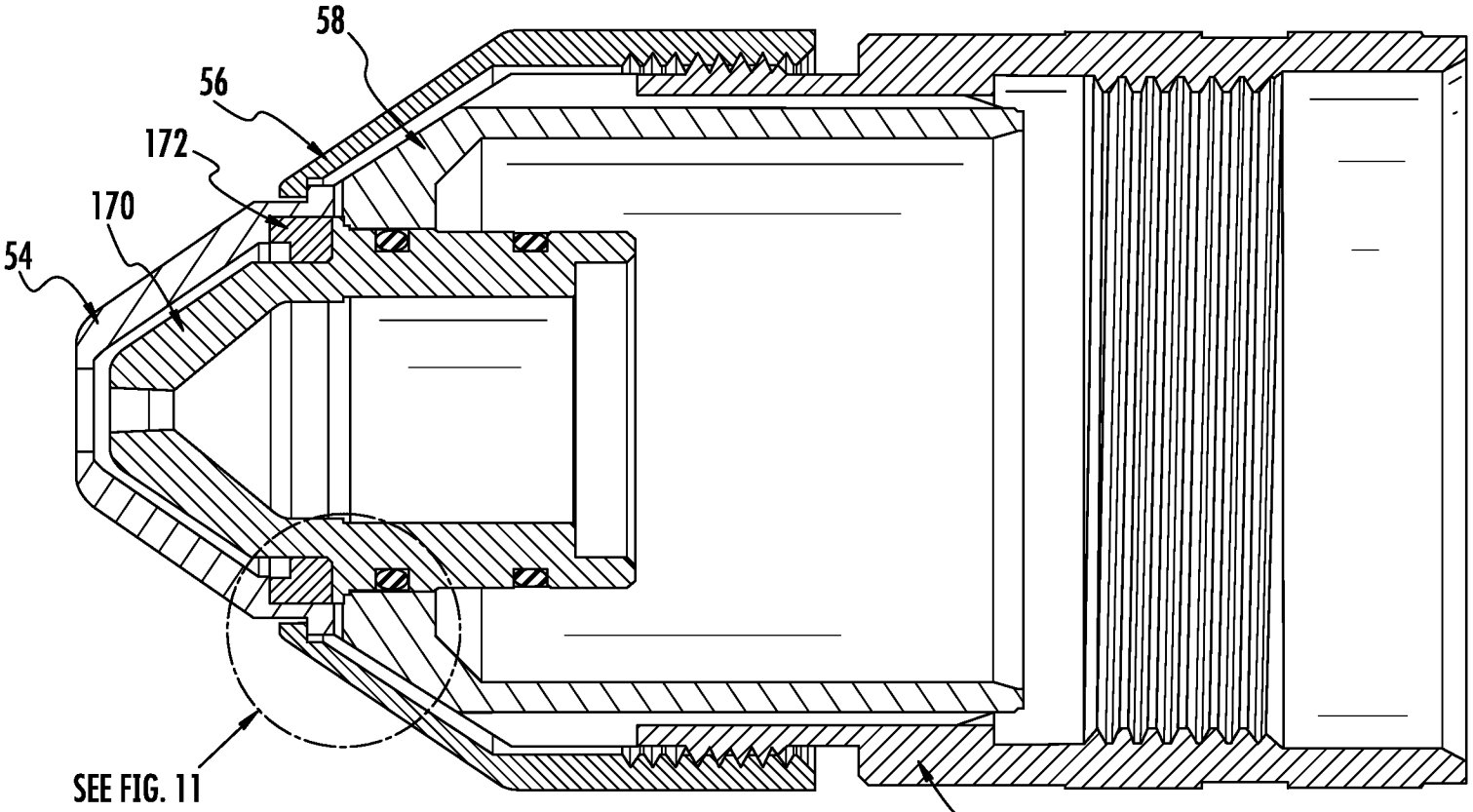
FIG. 7 is a cross-section view of an alternative embodiment of an exemplary front end portion of the plasma torch of FIG. 1.

The nozzle 14 is received within, and engages, several pieces of the plasma torch 10. A rearward facing surface 94 of the nozzle 14 engages a forward face 96 of the gas baffle 70. A rearward outer surface 98 of the nozzle 14 engages an inner surface 100 of the front body insert cap 64, while an intermediate outer surface 102 of the nozzle 14 engages an inner surface 104 of a forward portion 106 of the nozzle retaining cup insert 58. A forward portion 108 of the nozzle 14 has a general frustoconical shape that somewhat matches the shape of the shield 54. The nozzle 14 also has an internal cavity 110 that surrounds the electrode 20 as well as a portion of the electrode holder 18 in non-contact relation therein. The nozzle 14 further has a shoulder 154 (FIG. 6B) for engaging the nozzle-retaining cup insert 58 to prevent the nozzle 14 from moving axially rearward once installed. It will be appreciated that the shoulder 154 acts as a stop against rearward movement of the nozzle with respect to the nozzle-retaining cup insert once the shoulder 154 engages the nozzle retaining cup insert. Other examples of appropriate stops include a snap ring, a pressed on ring, such as an insulator or diffuser, a screwed on bushing, or other substitute for a shoulder which may occur to one skilled in the art so long as it can be assembled to the nozzle prior to the nozzle being placed into the nozzle retaining cup insert.

The nozzle retaining cup insert 58 includes a cylindrical rearward portion 112, while the forward portion 106 has a frustoconical shape that generally matches the shape of the forward portion 80 of the shield retainer 56. The rearward portion 112 of the nozzle retaining cup insert 58 has an inner surface 114 that is sized to be received by a corresponding cylindrical outer surface 116 of the front insulator body 68. The outer surface 116 of the front insulator body 68 may include a recess 118 configured to receive a sealing element 120 for sealing the front insulator body to the nozzle retaining cup insert 58. The nozzle retaining cup insert 58 may also include a shoulder 59 (FIG. 2) having a rearward surface 61 configured to engage a forward surface 63 of the nozzle retaining cup body 60 to prevent the nozzle retaining cup insert from moving axially rearward after the two pieces have been coupled.

The gas baffle 70 may be a generally cylindrical member received within a circumferential recess 122 in the front insulator body 68. As previously noted, the gas baffle 70 has a forward face 96 that engages a rearward facing surface 94 of the nozzle 14. A rear face 124 of the gas baffle engages a forward facing surface 126 of the circumferential recess. Thus, when the front end components are engaged with the remainder of the plasma torch 10, the gas baffle 70 is locked in the circumferential recess 122.

Figure 3:
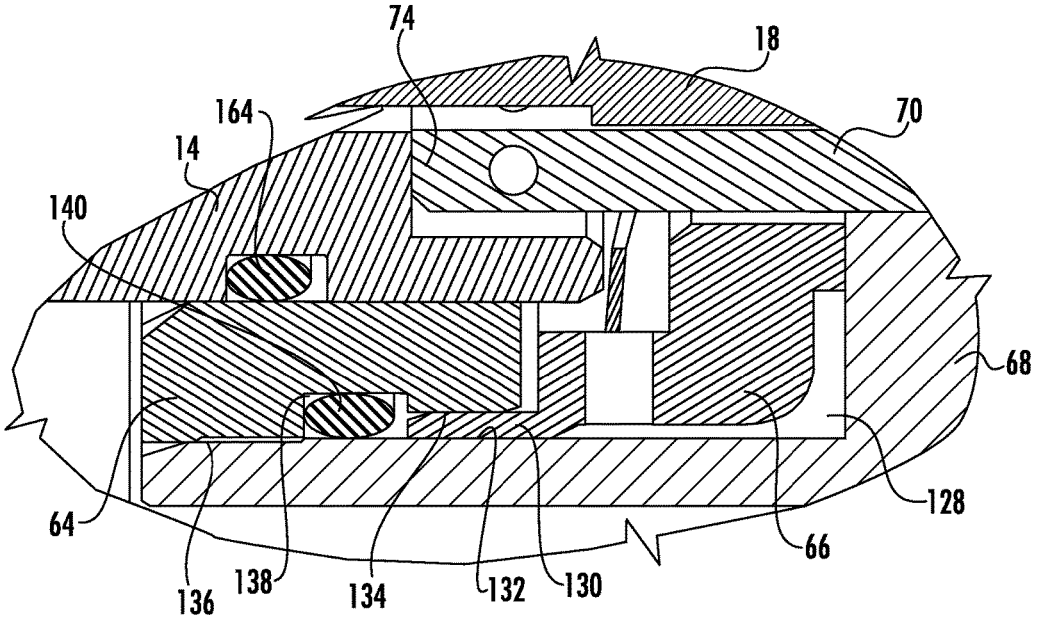
FIG. 3 is a detail view of a portion of the plasma torch of FIG. 1.

As can be seen in FIG. 3, the front body insert base 66 surrounds the baffle 70 in non-contact relation. The front body insert base 66 is received within a second circumferential recess 128 in the front insulator body 68. A forward lip 130 of the front body insert base 66 is fit between an inner surface 132 of the front insulator body 68 within the second circumferential recess 128 and a rearward outer surface 134 of the front body insert cap 64, which fixes the front body insert base 66 within the second circumferential recess.

The front body insert cap 64 is also disposed within the second circumferential recess 128 in the front insulator body 68, and is positioned forward of the front body insert base 66. As noted, a rearward outer surface 134 of the front body insert cap 64 presses the forward lip 130 of the front body insert base 66 against the inner surface 132 of the front insulator body 68. A forward outer surface 136 of the front body insert cap 64 engages the inner surface 132 of the front insulator body 68 in a press-fit manner. The front body insert cap 64 includes a circumferential recess 138 between the rearward and forward outer surfaces 134, 136. This recess 138 is configured to receive a sealing element 140 to seal the front body insert cap 64 to the front insulator body 68. In one embodiment, the sealing element 140 is an elastomeric O-ring.

Figure 4:
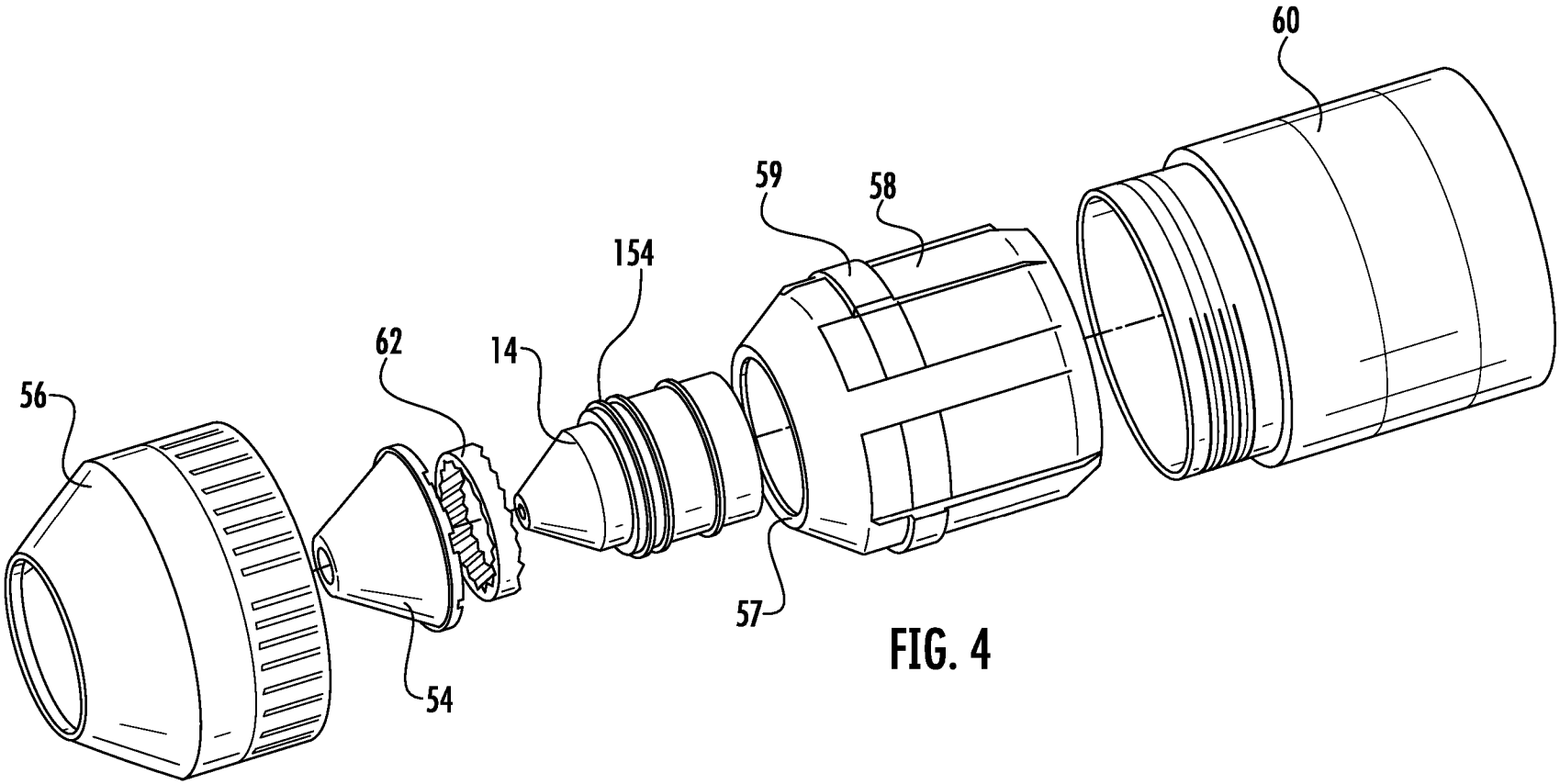
FIG. 4 is an exploded isometric view of a portion of the plasma torch of FIG. 1.
Figure 5:
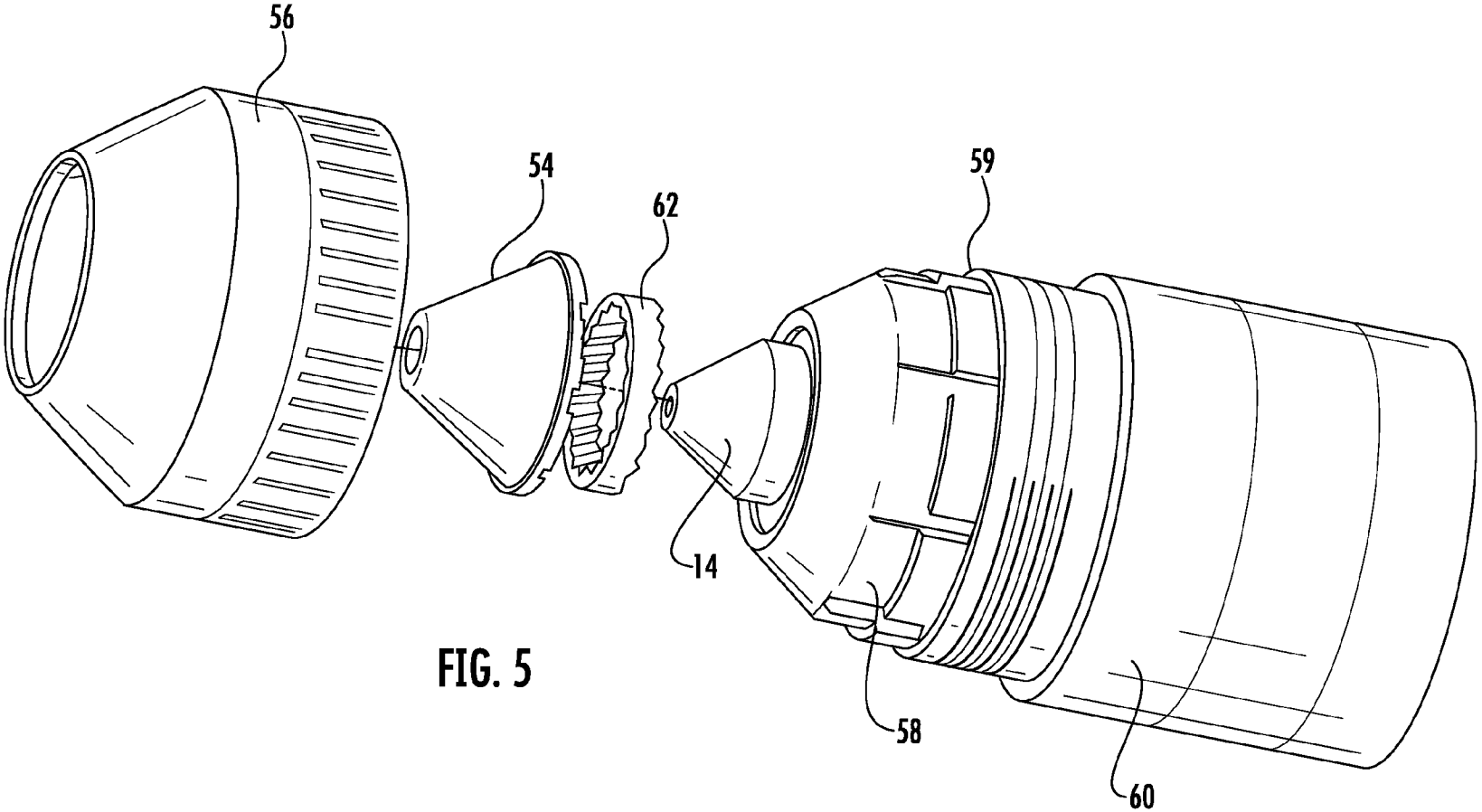
FIG. 5 is another exploded isometric view of a portion of the plasma torch of FIG. 1.

FIGS. 4 and 5 show the inter-relation of the front end components in an exploded isometric view (i.e., the unassembled state). FIG. 4 shows the shield retainer 56, shield 54, gas diffuser 62, nozzle 14, nozzle retaining cup insert 58 and nozzle retaining cup body 60 in coaxial alignment. FIG. 5 shows the front end components in a partially assembled state, with the nozzle inserted in the nozzle retaining cup insert 58, and nozzle retaining cup engaged with the nozzle retaining cup body 60. The shield retainer 56, shield 54 and gas diffuser 62 are aligned with, but positioned away from, the nozzle retaining cup insert 58 and nozzle 14.

Referring again to FIGS. 6A and 6B, the nozzle 14 will be described in greater detail. As can be seen, the nozzle 14 has a forward portion 108 of generally frustoconical shape and a central body portion 142 that has a generally cylindrical shape. The central body portion 142 itself includes first, second and third portions 144, 146, 148. The first portion 144 is adjacent to the forward portion 108 and includes a first shoulder 154. The first shoulder has a forward face 156 that engages a rear face 160 (FIG. 2) of the gas diffuser 62 to lock the gas diffuser between the nozzle 14 and the shield 54 when the components are assembled. The first shoulder 154 also has a rearward face 157 for engaging a nose portion 57 of the nozzle retaining cup insert 58 to prevent the nozzle from moving axially rearward once installed. As will be explained in greater detail later, the engagement between the first shoulder 154 and the nose portion 57 advantageously facilitates front loading of the nozzle 14 into the nozzle retaining cup insert 58, and the bottoming of the nozzle within the nozzle retaining cup insert.

As can be seen, the first portion 144 has a cylindrical portion 145 positioned forward first shoulder 154. This cylindrical portion 145 can be sized to receive an inner surface 93 (FIG. 2) of the gas diffuser 62 in a press-fit relation so that the gas diffuser is retained on the nozzle.

The first portion 144 also has a first recess 150 for receiving a first sealing element 152 (FIG. 1), which in the illustrated embodiment is an O-ring. The first portion has a first outer diameter D1 sized to provide close conformity between the first portion 144 and an inner surface 104 (FIG. 2) of the nozzle retaining cup insert 58. When installed, the first sealing element 152 seals the first portion 144 to the nozzle retaining cup insert 58.

The second portion 146 of the central body portion 142 has a second recess 162 for receiving a second sealing element 164 (FIG. 2), which in the illustrated embodiment is an O-ring. The second portion has a second diameter D2 sized to provide close conformity between the rearward outer surface 98 of the nozzle 14 and the inner surface 100 of the front body insert cap 64. When installed, the second sealing element 164 seals the second portion 146 to the front body insert cap 64. As can be seen, the second diameter D2 is smaller than the first diameter D1. As will be described in greater detail later this difference in diameters facilitates the installation/removal of the nozzle 14 from the front body insert cap 64 and the nozzle retaining cup insert 58 during assembly/disassembly.

The third portion 148 of the central body portion 142 includes an internal circumferential shoulder 166 disposed adjacent to the internal cavity 110. This internal circumferential shoulder seats against the forward portion 72 of the gas baffle 70 when the nozzle is installed. The circumferential shoulder 166 forms rearward facing surface 94 which, upon installation of the nozzle 14 in the plasma torch 10, abuts the forward portion 72 of the gas baffle 70, locking the gas baffle 70 between the nozzle and the front insulator body 68 as well as locking the nozzle in a desired axial position within the plasma torch 10.

As noted, the dimensions of the nozzle 14 are selected to facilitate installation and removal of the nozzle with respect to the remaining elements of the plasma torch 10. Specifically, the second diameter D2 of the second portion 146 is smaller than the first diameter D1 of the first portion 144. And as can be seen in FIGS. 1 and 2, the diameter D3 of the opening in the nozzle retaining cup insert 58 is larger than the diameter D4 of the opening in the front body insert cap 64. During installation and removal, this arrangement allows the second and third portions 146, 148 of the nozzle 14, along with second sealing element 164, to slide past inner surface 104 of the nozzle retaining cup insert 58 without interference from the nozzle retaining cup so that a smooth insertion can be achieved without damaging the second sealing element 164. Only when the first portion 144 of the nozzle 14 engages the inner surface 104 of the nozzle retaining cup insert 58 is a seal formed between the nozzle and the nozzle retaining cup insert owing to the first sealing element 152. The seal at 164 with the front body insert cap is made when the front end "unit" is assembled onto the rest of the plasma torch.

Selected non-limiting exemplary dimensions of the nozzle retaining cup insert 58, the nozzle 14, the front body insert cap 64, seal 164, and clearances therebetween are illustrated in Table 1, below.

TABLE 1

| Piece/Dimension | Example 1 | Example 2 |
|---|---|---|
| Nozzle Retaining Cup Insert ID @ 102 ± .001 | .965" | .994" |
| Nozzle OD @ 102 D1 ± .001 | .962" | .989" |
| Nozzle OD @ 98 D2 ± .001 | .927" | .975" |
| Front Body Insert Cap ID @ 100 ± .001 | .931" | .979" |
| Nozzle OD @ seal 164 ± .001 | .812" | .860" |
| O-ring wall & compression @ 164 (nominal) | .070" & 15% | .070" & 15% |
| Min Clearance D1 to Retaining Cup Insert @ 102 | .001" | .003" |
| Min Clearance D2 to Retaining Cup Insert @ 102 | .036" | .017" |
| Nominal Clearance 164 Seal to Nozzle Retaining Cup Insert @ 102 | .013" | −.006" |
| Min Clearance D2 to Front Body Insert Cap ID @ 100 | .002" | .002" |

Assembly of the front end "unit" can proceed as follows. The third portion 148 (FIG. 6B) of the nozzle 14 may be pushed through the ID (D3) of the nozzle retaining cup insert 58 until it bottoms (i.e., ribs 154 (FIG. 4) contact a nose portion 57 of the nozzle retaining cup insert of 58), "making" the seal 152, and sealing the nozzle 14 to the nozzle retaining cup insert 58. The nozzle retaining cup insert 58 may then be placed into an ID of the nozzle retaining cup body 60 so that the rearward surface 61 of the nozzle retaining cup insert engages a forward surface 63 of the nozzle retaining cup body 60. For embodiments in which the gas diffuser 62 is not a permanent part of the nozzle 14 or shield, the gas diffuser 62 may then be mounted on the nozzle. The shield 54 may be positioned so that it is centered to the nozzle 14 by the diffuser 62 and rests against the nose portion 57 of the nozzle retaining cup insert 58. The shield retainer 56 may then be screwed onto the nozzle retaining cup body 60 so that the shield 14 and the gas diffuser 62 are locked down. In this state, the nozzle 14 will be free to move a small amount axially. The front end unit is thereby assembled.

Next, assuming that the gas baffle 70, electrode holder 18, and electrode 20 are assembled in the torch, the front end unit can be installed by screwing the front end unit onto the threads 76*a* of the torch outer housing 76. The front end unit will bottom out on the gas baffle when a rearward facing surface 94 of the nozzle 14 engages a forward face 96 of the gas baffle 70.

A reversal of these steps can be employed to remove the front end unit from the remainder of the plasma torch 10.

As will be appreciated, providing the nozzle 14 with a hard stop against the nozzle retaining cup insert 58 enables the elements of the front end unit to be loaded from the front. This is in contrast to prior designs, such as those disclosed in U.S. Pat. No. 7,256,366 to Severance, Jr., which require loading of the elements of the front end unit from the back.

Moreover, with prior arrangements (such as those described in U.S. Pat. No. 7,256,366), the nozzle must be loaded onto a fixture that has threads for the nozzle retaining cup and a seat for the nozzle that simulates the gas swirl baffle. With the presently disclosed arrangement, the nozzle 14 loads into the front of the nozzle retaining cup insert 58 without the need for any sort of fixture. In addition, with prior arrangements, it is necessary to screw the cup onto the fixture so as to put the seal between the nozzle's shoulder and the lip in the nozzle retaining cup insert into compression. With the presently disclosed arrangement, this step is omitted. The nozzle retaining cup insert 58 is simply placed into the nozzle retaining cup body 60.

Further, with prior arrangements a nut must be screwed onto the nozzle to maintain compression of the seal between the nozzle's shoulder and the lip of the nozzle retaining cup insert. Alternatively, a clip is slipped into a groove in the nozzle to maintain compression of the seal. In either case, a fastener bears against the end of the nozzle retaining cup insert to keep compression on the seal. With the present design, a special fastener is not required to secure the nozzle or to maintain compression on a face seal, as the face seal has been eliminated. Finally, with prior designs the nozzle retaining cup/nozzle assembly must be removed from the special fixture, and the diffuser and shield must be secured in place using the shield retainer by screwing it onto the nozzle retaining cup body. Again, with the presently disclosed design no fixture is required to achieve this engagement.

As will be appreciated, the presently disclosed design provides the benefit of enabling the front end parts to be preassembled without the need for a special fixture, or for additional fasteners and tools for installing and removing the fasteners. The presently disclosed design makes assembly/disassembly more efficient.

As previously noted, the unique dimensional configuration of the individual pieces of the front unit allows a user to replace the consumable pieces of the torch without the need for a special fixture. It also ensures that the individual front end components are locked in desired axial and concentric position with respect to each other upon final tightening of the nozzle retaining cup body 60 on the torch outer housing 76.

Referring now to FIGS. 7-11, an alternative front end arrangement for use with the disclosed plasma torch 10 is disclosed. Similar to the arrangement described in relation to FIGS. 1-6B, the front end unit of FIGS. 7-11 includes a shield 54, shield retainer 56, nozzle retaining cup body 60, nozzle 170 and gas diffuser 172. The shield, shield retainer and nozzle retaining cup body may be substantially the same as the those described in relation to FIGS. 1-6B. The nozzle 170 and gas diffuser 172 may also be similar to those described in relation to FIGS. 1-6B, with differences that will now be described.

Figure 8:
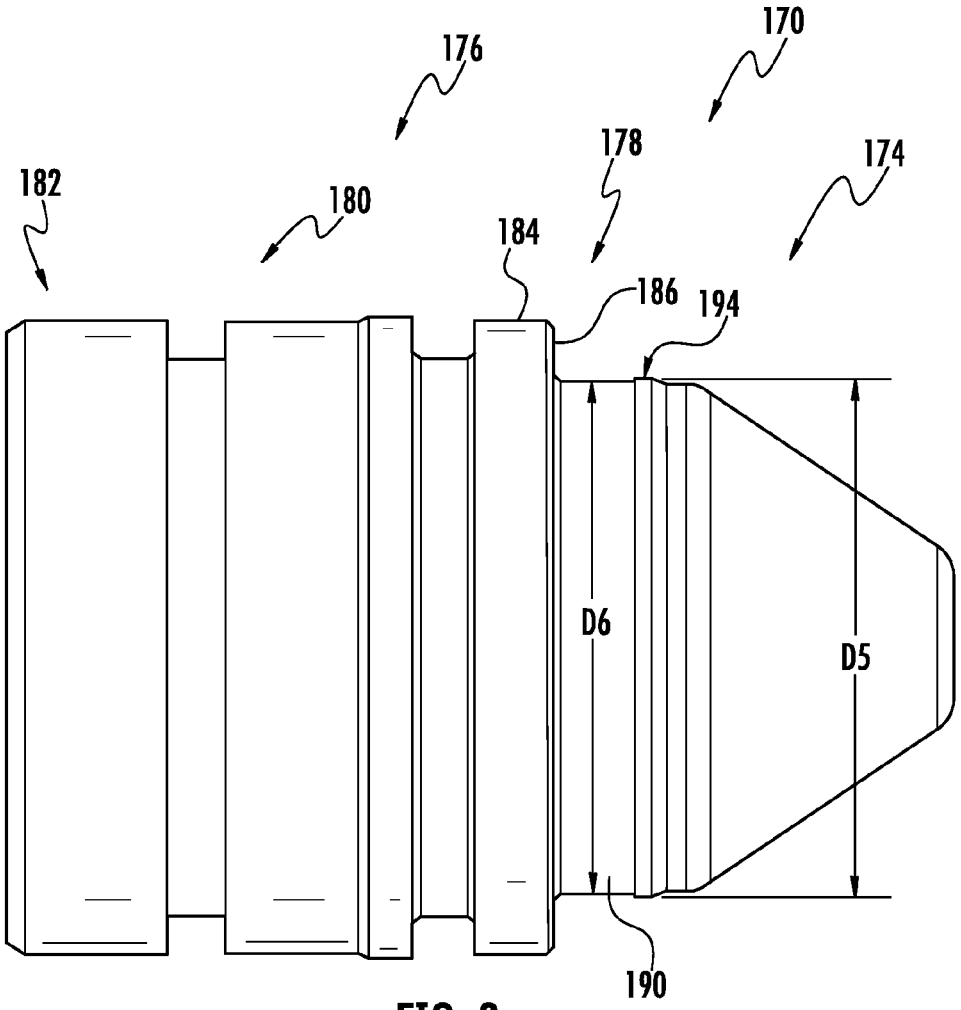
FIG. 8 is a detail view of a portion of the front end portion of FIG. 7.
Figure 9C:
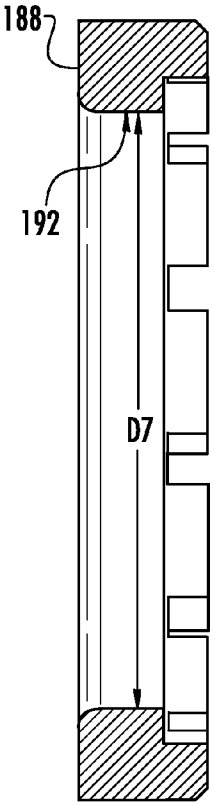
FIGS. 9A, 9B and 9C are top, side and cross-section views, respectively, of an exemplary gas diffuser of the front end portion of FIG. 7.
Figure 9B:
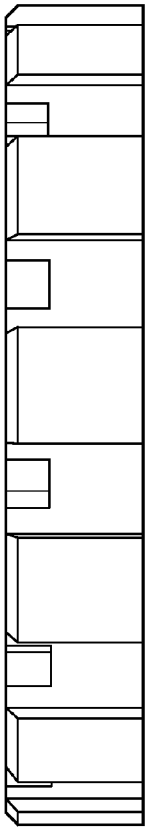
Figure 9A:
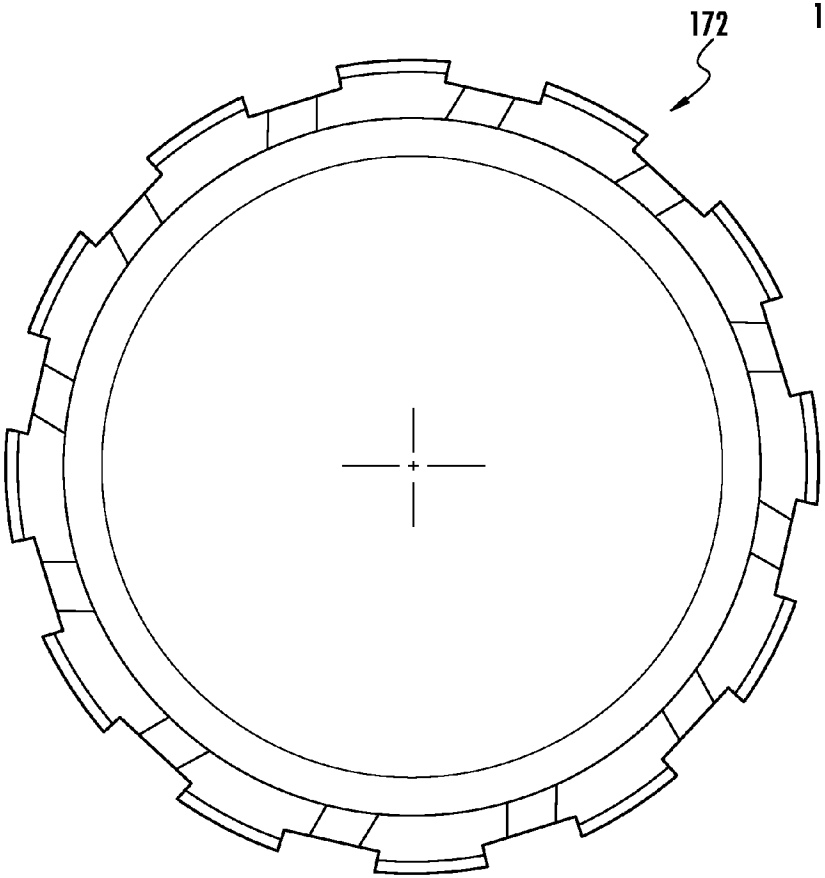

Referring to FIG. 8, the nozzle 170 may include all of the features described in relation to the nozzle 14 with the exception that it may have one or more features configured to allow snap-fit engagement with the gas diffuser 172. In some embodiments, the gas diffuser 172 may be formed from a polymer. In one non-limiting exemplary embodiment the gas diffuser 172 is a glass-reinforced polyetherimide. Other exemplary materials include glass-filled expoxies such as G-10, unreinforced polyimides like Vespel, Meldin 7000, or Tecasint 2011, Torlon, glass-filled PEEK, or unreinforced polyetherimides. In addition, a ceramic material could be used, and it could be cemented in place, or material from the nozzle could be rolled over it to secure it. Thus, any of a variety of materials can be used as long as they function as an electrical insulator and are reasonably resistant to temperature. In some embodiments the gas diffuser 172 may comprise anodized aluminum. The gas diffuser 172 may be formed by an injection molding process or other suitable process. As such, the gas diffuser 172 may have sufficient elastic properties to allow it to snap onto the nozzle 170 during installation. The nozzle 170 may include a forward portion 174 of a general frustoconical shape that matches the shape of the shield 54. A central body portion 176 has a generally cylindrical shape, and may be divided into first, second and third portions 178, 180 and 182. The first portion 178 is adjacent to the forward portion 174 and includes a first shoulder 184. The first shoulder has a forward face 186 that engages a rear face 188 (FIG. 9C) of the gas diffuser 172 to lock the gas diffuser between the nozzle 170 and the shield 54 when the components are assembled. The first portion 178 has a cylindrical portion 190 positioned forward first shoulder 184. This cylindrical portion 190 is sized to receive an inner surface 192 (FIG. 9C) of the gas diffuser 172. A second shoulder 194 is disposed at the forward end of the cylindrical portion 190 directly adjacent to the frustoconical forward portion 174. This second shoulder 194 may have a shoulder diameter D5 that is slightly larger than the outer diameter D6 of the cylindrical portion 190. The shoulder diameter D5 may also be slightly larger than the inner diameter D7 (FIG. 9C) of the gas diffuser 172. In some embodiments, the clearance between D6 D7 may be from 0-inches to about 0.003-inches, while D5 may be at least 0.004-inches greater than D7. It will be appreciated that these dimensions are not limiting, and that other clearances can be used as desired.

Figure 10:
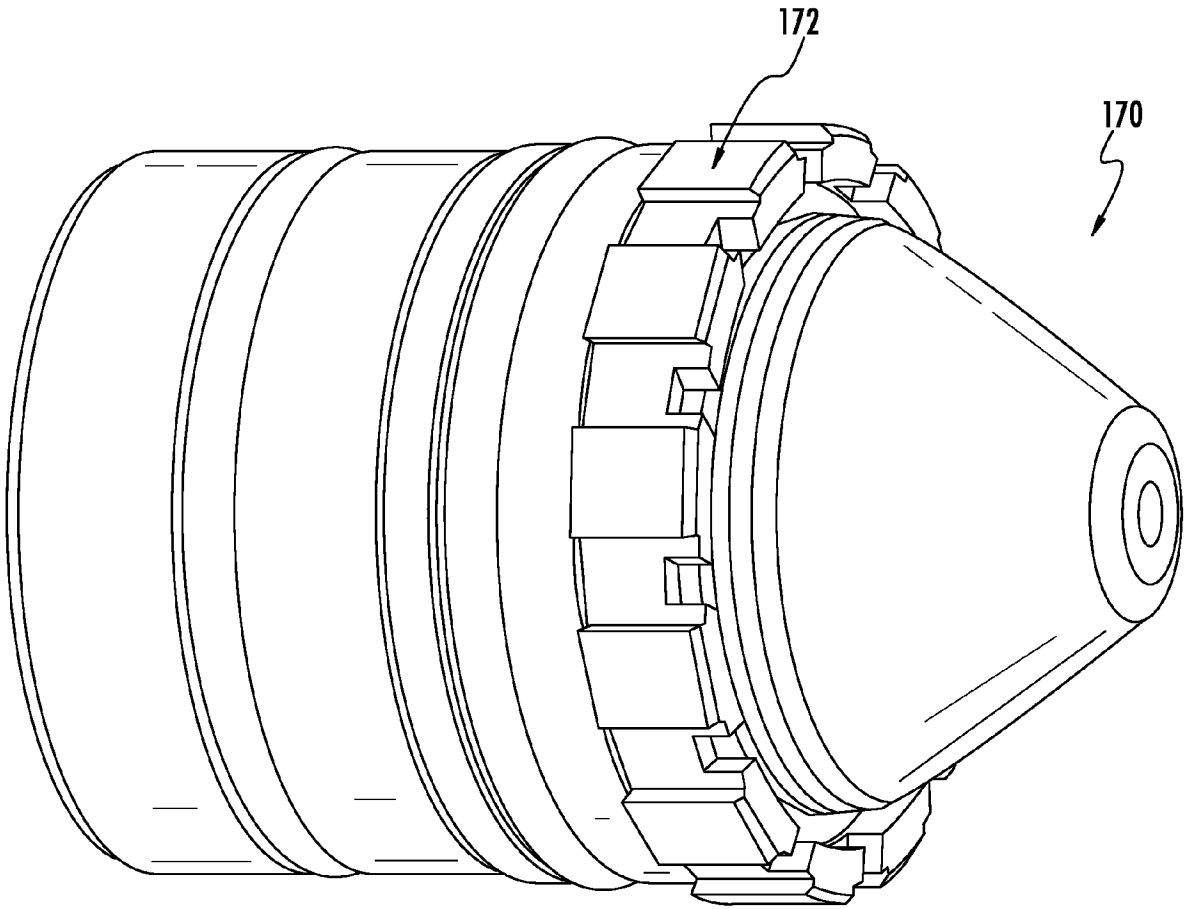
FIG. 10 is an isometric view of a nozzle and gas diffuser of the front end portion of FIG. 7.
Figure 11:
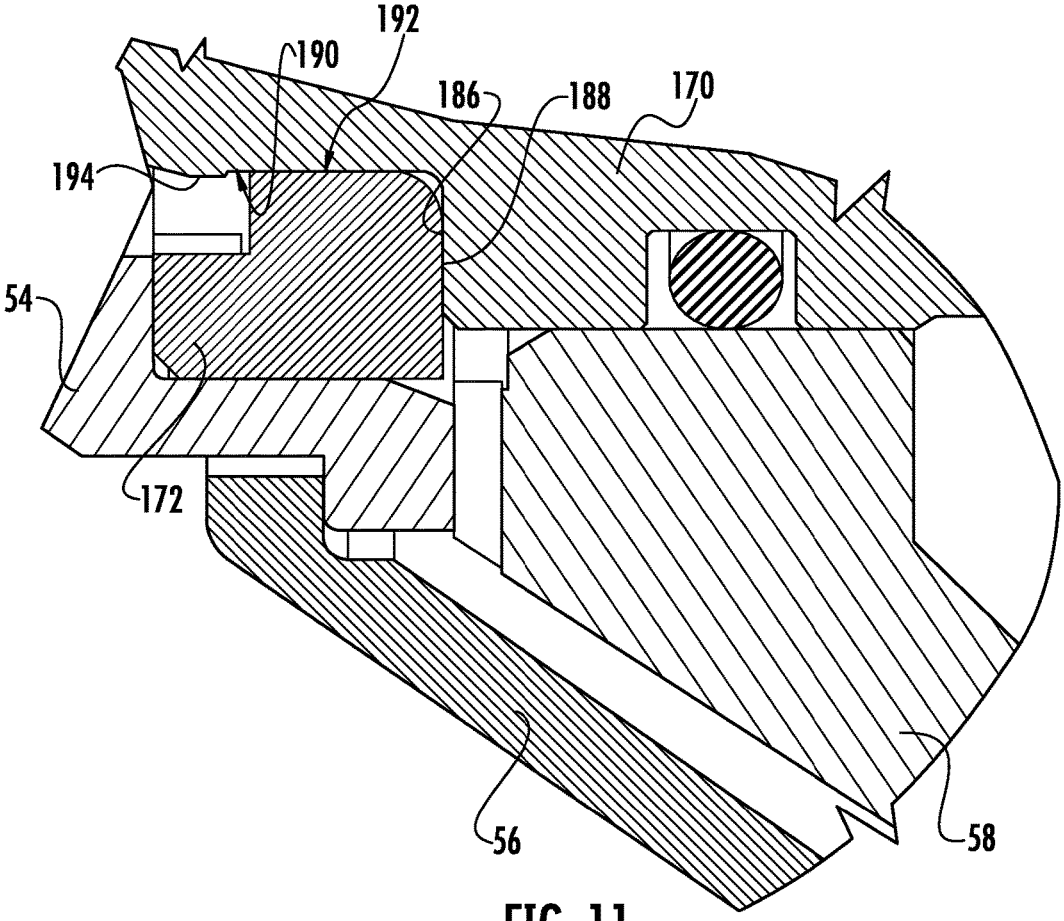
FIG. 11 is a detail view of a portion of FIG. 7

As will be appreciated, this slight difference in diameters between the nozzle 170 and the gas diffuser 172 enables the gas diffuser to be snapped onto the cylindrical portion 190 of the nozzle during installation. The gas diffuser 172 is then retained on the nozzle 170 by the second shoulder 194. FIG. 10 shows the gas diffuser 172 installed on the nozzle 170. FIG. 11 shows the relative arrangement of the gas diffuser 172, the nozzle 170, the shield 54, the shield retainer 56 and the nozzle retaining cup insert 58. As can be seen, the inner surface 192 of the gas diffuser 172 is received within the trough of the cylindrical portion 190 of the nozzle 170, and is retained by the second shoulder 194.

The embodiment of FIGS. 8-11 enables the use of a relatively inexpensive injection molded gas diffuser that can be permanently pressed or snapped onto the nozzle. The diffuser then serves as the feature that the nozzle retaining cup insert 58 bears against to pull the nozzle out of the torch when the front end parts are removed. A side benefit is that nozzle/shield concentricity may be improved.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation. While the present invention has been disclosed with reference to certain embodiments, numerous modifications, alterations and changes to the described embodiments are possible without departing from the spirit and scope of the invention, as defined in the appended claims. Accordingly, it is intended that the present invention not be limited to the described embodiments, but that it has the full scope defined by the language of the following claims, and equivalents thereof.

What is claimed is:

1. A front end assembly for a plasma arc torch, the front end assembly comprising:

a nozzle retaining cup body having a rearward end removably connectable to a body of the plasma arc torch and a forward end removably connectable to a shield retainer, the shield retainer having a surface for engaging a shield;

a nozzle retaining cup insert receivable in an interior space formed by the nozzle retaining cup body, the nozzle retaining cup insert having a forward portion extending forwardly beyond a forward end of the nozzle retaining cup body;

a nozzle receivable within an interior space formed by the nozzle retaining cup insert, a first central portion of the nozzle having a first diameter, the first central portion positioned in close confronting relation with the forward portion of the nozzle retaining cup insert, the nozzle further including a stop having a rearward facing surface that is engageable with a forward-most surface of a nose portion of the nozzle retaining cup insert to prevent axial movement towards the rear of the nozzle retaining cup insert once the stop and the nose portion are engaged; and an insulator disposed between the shield and the nozzle, wherein engagement of the shield with the insulator and engagement of the insulator with a forward facing surface of the nozzle limits forward axial movement of the nozzle.

2. The front end assembly of claim 1, wherein the stop is selected from the group consisting of a shoulder, snap ring, a pressed on ring and a bushing.

3. The front end assembly of claim 1, wherein the nozzle includes a second central portion of the nozzle having a second diameter that is smaller than the first diameter.

4. The front end assembly of claim 3, wherein the insulator has grooves, slots or holes so that it constitutes a fluid diffuser.

5. The front end assembly of claim 4, wherein the gas diffuser is received on a cylindrical outer surface portion of the nozzle, the nozzle having a shoulder disposed adjacent the cylindrical outer surface, the shoulder having an outer diameter that is larger than an inner diameter of the gas diffuser gas to enable the gas diffuser to be snapped over the shoulder to be captured on the cylindrical outer surface.

6. The front end assembly of claim 5, wherein the first central portion of the nozzle comprises a recess with a seal disposed therein, the seal engaging the forward portion of the nozzle retaining cup insert to seal the nozzle to the nozzle retaining cup insert.

7. The front end assembly of claim 6, wherein the second central portion of the nozzle comprises a recess with a seal disposed therein, the second central portion positioned in close confronting relation with a front body insert cap engaged with a front insulator body portion of the plasma arc torch body, the seal engaging the front body insert cap to seal the nozzle to the front body insert cap and front insulator body portion.

8. The front end assembly of claim 6, wherein the second central portion of the nozzle comprises a recess with a seal disposed therein, the second central portion positioned in close confronting relation with a unitary front body insert of the plasma arc torch body, the seal engaging the front body insert to seal the nozzle to the front body insert and front insulator body portion.

9. The front end assembly of claim 6, wherein the first and second diameters are selected so that second central portion of the nozzle can pass through the forward portion of the nozzle retaining cup insert without engaging the second central portion with the forward portion of the nozzle retaining cup insert.

10. The front end assembly of claim 1, wherein the shield, shield retainer, nozzle retaining cup body, nozzle and insulator are respectively concentrically and axially aligned with each other to form a unit that is removable from the torch body assembly, wherein the unit is removable to enable a user to access an electrode of the plasma arc torch.

11. The front end assembly of claim 1, wherein the shield is axially retained in a first direction by the shield retainer, the shield retainer is axially retained in the first direction by the nozzle retaining cup body, the insulator is axially retained in the first direction by the shield, and the nozzle is axially retained in the first direction by the insulator.

12. The front end assembly of claim 10, wherein the shield, insulator, nozzle, shield retainer, nozzle retaining cup insert and nozzle retaining cup body are correspondingly concentrically aligned when coupled together away from the torch body.

13. The front end assembly of claim 1, further comprising a cylindrical gas baffle positioned between a rearward facing surface of the nozzle and a forward facing surface of the plasma arc torch body, the cylindrical gas baffle being coupled to the nozzle such that when the nozzle is removed from the plasma arc torch the cylindrical gas baffle moves with the nozzle.

14. The front end assembly of claim 13, wherein the cylindrical gas baffle is coupled to the nozzle by at least one of threads, an o-ring, a snap ring, a press fit, and adhesive.

15. A method for assembling a front end unit for a plasma arc torch, comprising:

receiving a rear portion of a nozzle through an ID of a nozzle retaining cup insert until a stop portion of the nozzle contacts a nose portion of the nozzle retaining cup insert, thereby engaging a seal between the nozzle and the nozzle retaining cup insert, the stop having a rearward facing surface that is engageable with a forward-most surface of a nose portion of the nozzle retaining cup insert;

receiving the nozzle retaining cup insert and nozzle in an ID of a nozzle retaining cup body so that a rearward surface the nozzle retaining cup insert engages a forward surface of the nozzle retaining cup body;

mounting a gas diffuser on the nose portion of the nozzle;

centering a shield on the nozzle using the gas diffuser;

engaging the shield against the nose portion of the nozzle retaining cup insert; and screwing a shield retainer onto the nozzle retaining cup body so that the shield and the gas diffuser are locked thereto.

16. The method of claim 15, further comprising engaging the nozzle retaining cup body with an outer body portion of a torch body.

17. The method of claim 15, wherein the nozzle comprises a first central portion having a first diameter, the first central portion having a first circumferential recess and a first seal disposed therein, the nozzle further including a second central portion having a second circumferential recess and a second seal disposed therein, wherein when the nozzle retaining cup body is engaged with an outer portion of a torch body the first seal engages the nozzle retaining cup insert and the second seal engages a front body insert cap.

18. The method of claim 17, wherein when the nozzle retaining cup body is engaged with an outer portion of a torch body a central opening in the nozzle is aligned with a plasma gas supply from the torch body, and a space between the nozzle and the shield is aligned with a shield gas supply from the torch body.

19. The method of claim 15, wherein engaging an insulator on a forward cylindrical surface of the nozzle comprises snapping the insulator over a shoulder formed adjacent to the forward cylindrical surface.

20. The method of claim 15, wherein engaging the shield retainer with the nozzle retaining cup body comprises engaging corresponding inner and outer threaded portions thereof.

21. The method of claim 15, wherein engaging the nozzle retaining cup body with an outer body portion of a torch body comprises engaging corresponding inner and outer threaded portions thereof.

22. A front end unit for a plasma arc torch, the front end unit comprising a nozzle, and a nozzle retaining cup or a nozzle retaining cup insert, wherein the nozzle includes a stop extending radially from the nozzle and having a rearward facing surface facing a body of the plasma arc torch, wherein the rearward facing surface limits axial travel by bearing against a front-most located surface of the nozzle retaining cup or the nozzle retaining cup insert so that the nozzle cannot remain in the torch when the nozzle retaining cup is removed.

23. The front end unit of claim 22, wherein the stop comprises a component assembled onto the nozzle before the nozzle is assembled with the nozzle retaining cup or the nozzle retaining cup insert.

24. The front end unit of claim 22, wherein the stop is a shield gas diffuser or insulator, and is pressed, snapped, glued, or otherwise affixed to the nozzle.

25. The front end unit of claim 22, wherein the stop is a snap ring, a threaded nut, or a collar affixed to the nozzle.

26. A front end assembly for a plasma arc torch, the front end assembly comprising:

a nozzle retaining cup body having a rearward end removably connectable to a body of the plasma arc torch and a forward end removably connectable to a shield retainer, the shield retainer having a surface for engaging a shield;

a nozzle retaining cup insert receivable in an interior space formed by the nozzle retaining cup body, the nozzle retaining cup insert having a forward portion extending forwardly beyond a forward end of the nozzle retaining cup body; and a nozzle receivable within an interior space formed by the nozzle retaining cup insert, a first central portion of the nozzle positioned in close confronting relation with the forward portion of the nozzle retaining cup insert, the nozzle further including a stop having a rearward facing surface that is engageable with a forward-most surface of a nose portion of the nozzle retaining cup insert to prevent axial movement towards the rear of the nozzle retaining cup insert once the stop and the nose portion are engaged.

27. A front end assembly including a nozzle retaining cup insert, a nozzle retaining cup body, and a shield retainer cup, wherein the nozzle retaining cup insert is axially limited in movement by a rearward facing surface of a shoulder of the nozzle retaining cup insert, the rearward facing surface facing a body of a plasma arc torch and bearing against a forward-most positioned surface of a nose portion of the nozzle retaining cup body and by another surface that bears against a forward portion of the shield retainer.

28. The front end assembly of claim 27, wherein passages for shield gas are provided in the face of the nozzle retaining cup insert.

* * * * *